US005888707A

United States Patent [19]

Jansen et al.

[11] Patent Number: 5,888,707

[45] Date of Patent: Mar. 30, 1999

[54] METHOD OF PROCESSING PHOTOGRAPHIC MATERIAL

[75] Inventors: Benedictus Jansen, Geel; Frank Michiels, Arendonk, both of Belgium

[73] Assignee: Agfa-Gevaert, Mortsel, Belgium

[21] Appl. No.: 977,329

[22] Filed: Nov. 24, 1997

[30] Foreign Application Priority Data

Nov. 25, 1996 [EP] European Pat. Off. ..... 96203298

[51] Int. Cl.[6] ..... G03C 5/395

[52] U.S. Cl. ..... 430/398; 430/400

[58] Field of Search ..... 430/398, 400

[56] References Cited

U.S. PATENT DOCUMENTS 1,876,830 9/1932 Balassa ..... 430/398

3,746,543 7/1973 Iwano et al. ..... 430/398

4,139,431 2/1979 Scheidegger et al. ..... 430/398

*Primary Examiner*—Hoa Van Le

*Attorney, Agent, or Firm*—Baker & Botts, L.L.P.

[57] ABSTRACT

A method of processing photographic material comprises developing the photographic material by treatment with a developer (26), and fixing the developed photographic material by treatment with a fixer (32, 38) while reducing the level of silver ions in the fixer (38) by electrolysis. Between the developing and the fixing, the photographic material is treated with an intermediate treatment liquid (44) for a period of time less than the treatment time with the fixer (32, 38). The intermediate treatment liquid (44) contains used fixer (38). The efficiency of fixing is improved without the use of substantially greater liquid volumes and in particular without the use of further quantities of water.

6 Claims, 1 Drawing Sheet

METHOD OF PROCESSING PHOTOGRAPHIC MATERIAL

FIELD OF THE INVENTION

This invention relates to a method and apparatus for processing photographic material, in particular exposed silver-based photographic sheet materials such as X-ray film, graphic art film and paper, and roll films.

BACKGROUND OF INVENTION

A typical photographic material processing method comprises developing the photographic material by treatment with a developer, and fixing the developed photographic material by treatment with a fixer. During the fixing step, the non-developed silver halide is removed from the photographic material and silver ions build up in the fixer, having the effect of slowing down the fixing process. It is therefore not unusual to reduce the level of silver ions in the fixer by electrolysis, for example by passing the fixer around a circulation loop which includes an electrolytic cell. Electrolytic removal of silver also has the benefit of enabling a lower regeneration rate of fixer to be used and this is consistent with recent trends to reduce the volume of treatment liquids used in photographic processing.

In such a process the photographic material which passes from the developer to the fixer carries with it a certain amount of developer liquid, containing used and unused developing agents and other components, which act as contaminants to the fixer. The consequence of this "carry-over" is that the time required for the photographic material to be fixed in the fixer, i.e. for the silver ion content of the photographic material to be reduced to a predetermined low level, is lengthened. The greater the degree of carry-over, the longer is the required fixing time. While improved apparatus design, such as the design of transport rollers used to feed the photographic material through the apparatus, can reduce the level of carry-over, it has not so far been possible to totally eliminate carry-over, and the corresponding time-loss in the fixing step.

While it has been proposed to rinse the photographic material with water or a rinse liquid between the developer and the fixer, to wash off carried-over developer and thus reduce the increase in fixing time which the carried-over developer would cause, the time taken for such rinsing becomes a factor in the overall processing time, so that any benefits obtained from more efficient fixing are not wholly realised. Furthermore, there is a trend towards processes which consume lower amounts of water. One disadvantage of rinsing with water between the developer and fixer is the production of an additional waste stream. Moreover, an undesired brownish discolouration may arise from oxidation of developer components, which may foul the photographic material. This discolouration is particularly severe when low levels of rinse water are used in order to limit the additional waste. Another disadvantage is the additional time necessary, which is wasted time as this time is not used for processing.

In general, the efficiency of fixing can be improved by the use of "cascade" fixing, in which the photographic material passes through two fixing vessels, the fixer moving counter-current to the photographic material. The period of time spent by the photographic material in the fixer is thereby increased while the volume of fixer required to fill the processing apparatus is increased.

OBJECTS OF INVENTION

It is object of this invention to provide a method and apparatus whereby the retardation of the fixing process caused by the carry-over of developer can be minimised with minimal loss of processing speed and without causing additional waste, and especially where the fixer is de-silvered on-line. It is a preferred object of the invention to provide a method and apparatus whereby the retardation of the fixing process caused by the carry-over of developer when the rate of regeneration of the fixer is low, since the retardation of the fixing process is especially severe in this case.

SUMMARY OF THE INVENTION

We have discovered that this and other useful objectives can be achieved where, between the developing and the fixing, photographic material is treated with an intermediate treatment liquid for a relatively short period of time, the intermediate treatment liquid containing used fixer.

Thus, according to a first aspect of the invention, there is provided a method of processing photographic material comprising developing the photographic material by treatment with a developer, and fixing the developed photographic material by treatment with a fixer while reducing the level of silver ions in the fixer by electrolysis, characterised in that, between the developing and the fixing, the photographic material is treated with an intermediate treatment liquid for a period of time less than the treatment time with the fixer, the intermediate treatment liquid containing used fixer.

While not wishing to be bound by theory, we believe that the treatment of the photographic material with the intermediate treatment liquid has the effect of flushing out developer from the photographic material, in particular from the gelatine layer(s) thereon. Furthermore, we believe that the use of used fixer for this intermediate treatment liquid has the effect of triggering the start of the fixing reactions. As a result, once the photographic material passes from the intermediate treatment liquid into the fixer, the fixing reactions quickly reach their optimum rate. It is believed that if photographic material is passed directly from the developer into the fixer, as in the prior art processes, the carried-over developer hampers the fixing process, especially when low fixer regeneration is used. This is particularly the case when electrolytic silvering is used on-line, since this allows for very low fixer regeneration rates, since the accumulation of silver in the fixer and the corresponding fixing rate decrease is avoided.

Preferably, the photographic material is treated with the intermediate treatment liquid for a period of time less than half that of the fixer treatment time, most preferably less than 25% that of the fixer treatment time. Where treatment with the fixer takes place in two or more vessels, the intermediate treatment time is to be compared with the total fixer treatment time. Treatment with the intermediate treatment liquid for a relatively short period of time can most easily be achieved by providing a shorter photographic material transport path through the intermediate treatment liquid, for example by providing the intermediate treatment liquid in an intermediate vessel having a path length less than that of the vessel containing the fixer, thereby enabling the photographic material to pass through the apparatus at a constant speed.

The fixing may take place in one or more fixing vessels which are regenerated by the addition thereto of a regeneration liquid. Preferably, the regenerating liquid is added at a rate of less than 100 ml/g silver to be fixed, preferably less than 75, such as less than 50, especially not more than 25 ml/g Ag calculated on the basis of the regeneration liquid having the same composition as that of the fixing liquid before use. Where the regeneration has some other concentration of active ingredients, an appropriate adjustment to these figures should be made. As the fixer is regenerated by the addition of the regeneration liquid thereto, used fixer may be simultaneously transferred to the intermediate treatment liquid, and used intermediate treatment liquid is discharged. The rate of addition of the regeneration liquid to the fixer, the rate of transfer of used fixer to the intermediate treatment liquid and the rate of discharge of used intermediate liquid may be such, in relation to each other, as to maintain the volumes of the fixer and the intermediate liquid substantially constant. In one embodiment of the invention, the photographic material is processed at a rate of from 0.1 $m^2$/minute to 1.0 $m^2$/minute, the regeneration liquid is added to the fixer at the rate of from 50 ml/$m^2$ to 250 ml/$m^2$, the used fixer is added to the intermediate liquid at the rate of from 50 ml/$m^2$ to 250 ml/$m^2$, silver ions are electrolytically removed from the fixer at the rate of up to 40 g Ag/hour, and the used intermediate liquid is discharged at a rate of from 50 ml/$m^2$ to 250 ml/$m^2$.

Usually the intermediate treatment liquid will consist only of used fixer, but will of course become contaminated in use with developer carried-over with the photographic material.

According to a second aspect of the invention there is provided an apparatus for the processing of photographic material comprising a plurality of treatment vessels including a developing vessel and a fixing vessel, the apparatus including means for feeding photographic material to be processed along a photographic material path through the developing vessel and the fixing vessel in turn, and an electrolytic cell for removing silver ions from fixer in the fixing vessel, characterised in that an intermediate treatment vessel, having a photographic material path length less than that of the fixing vessel, is positioned between the developing vessel and the fixing vessel and means are provided for feeding used fixer from the fixing vessel to the intermediate vessel.

The apparatus may further comprise a pump for pumping used fixer from the fixing vessel to the intermediate treatment vessel.

Alternatively, the fixing vessel and the intermediate vessel have a cascade relationship whereby used fixer overflows from the fixing vessel into the intermediate vessel as regeneration liquid is added to the fixing vessel.

The treatment vessels may be positioned one above the other in a vertical configuration. In particular, the developing vessel may be positioned above the intermediate vessel which in turn is positioned above the fixing vessel. This configuration is preferred, in order to prevent fixer from entering the developing vessel. However, in such an arrangement, a pump will be required to transfer used fixer upwardly into the intermediate vessel.

Alternatively, the vessels are positioned side by side in an essentially horizontal configuration, especially where the fixing vessel and the intermediate vessel having a cascade relationship.

The electrolytic silver recovery cell may be of known construction. For example, the cell comprises a cylindrical housing fitted with a central anode surrounded by a removable cathode. The housing has inlets and outlets for the liquid to be de-silvered. A glass reference electrode enables control of the de-silvering process, which is carried out either at constant potential, at constant current or according to some other control regime. As the de-silvering process proceeds, silver is deposited and builds up on the cathode. The cathode is periodically replaced. Silver can be recovered from the used cathode in a known manner, and usually the cathode can be re-used.

DETAILED DESCRIPTION OF THE INVENTION

Figure 1:
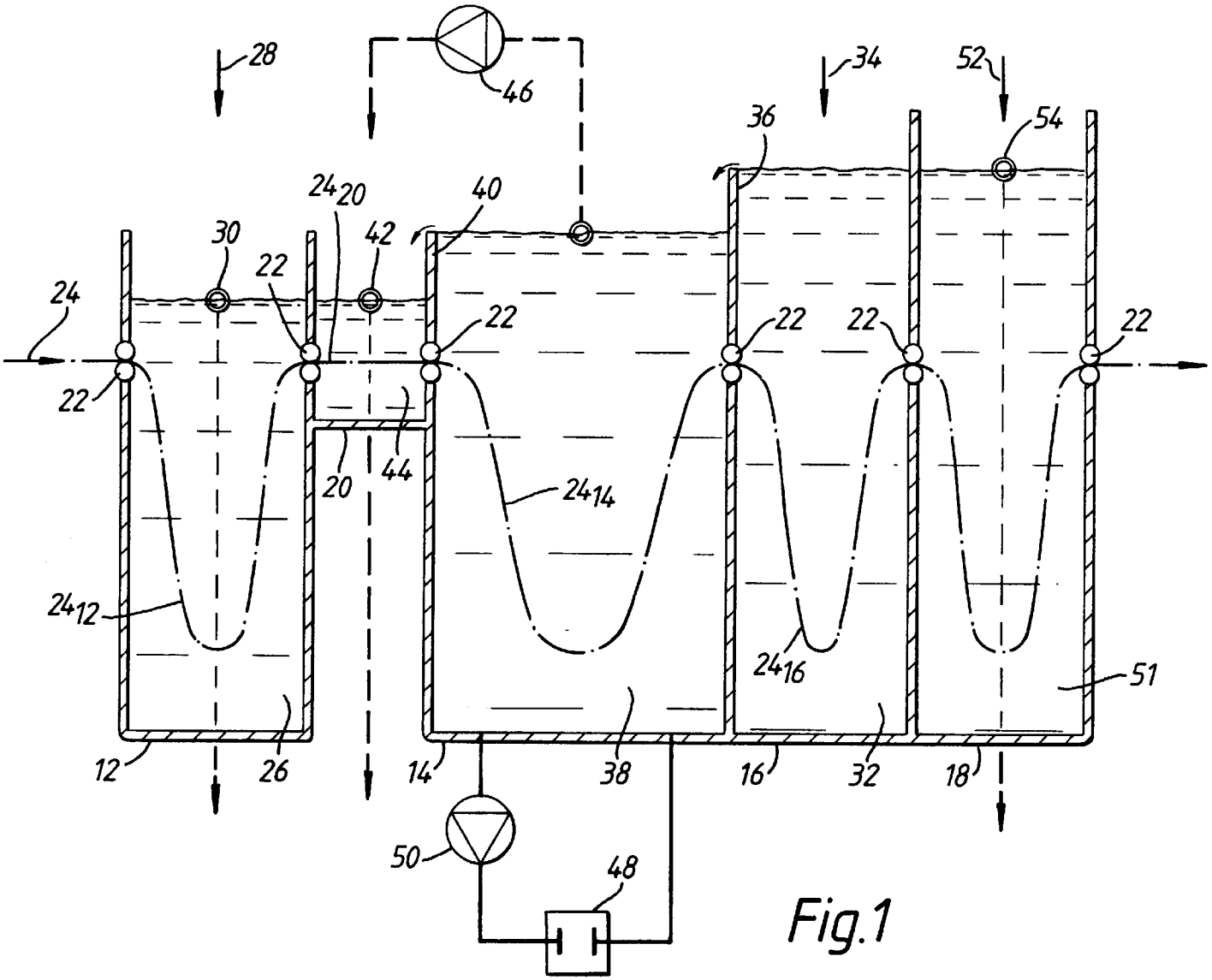

The invention will be described by the following illustrative embodiments with reference to the accompanying drawings without the intention to limit the invention thereto, and in which:

FIG. 1 shows schematically an apparatus for use in the processing of photographic material, according to the invention, the apparatus having a horizontal configuration.

The apparatus shown in schematically FIG. 1 comprises a number of treatment vessels including a development vessel 12, first and second fixing vessels 14, 16 and a rinsing vessel 18. Between the developing vessel 12 and the first fixing vessel 14 there is positioned an intermediate treatment vessel 20. Means are provided, including driven pairs of co-operating rollers 22 to define photographic material transport path 24 through the vessels in turn. The roller pairs 22 are provided with sealing means not shown. The developing, fixing and rinsing vessels have further pairs of rollers and guide plates not shown to ensure that the photographic material passes through these vessels along a circuitous path sections $\mathbf{24}_{12}$, $\mathbf{24}_{14}$, $\mathbf{24}_{16}$, $\mathbf{24}_{18}$, the lengths of which determines the processing time in these vessels. In contrast, the photographic material path section $\mathbf{24}_{20}$ through the intermediate treatment vessel 20 is straight.

Developer liquid 26 is added to the developer vessel 12 at 28 and waste developer is discharged at 30.

Fresh fixer liquid 32 is added to the second fixer vessel 16 at 34. The second and first fixing vessels 16, 14 are in cascade relationship with each other. Thus, once the level of fixer in the second fixing vessel 16 reaches the height of the wall 36 between the second and first fixing vessels, the partly used fixer overflows into the first fixing vessel 14, and fills the latter to the height of the wall 40 between the first fixing vessel 14 and the intermediate treatment vessel 20.

The first fixing vessel 14 and the intermediate vessel 20 are also in cascade relationship with each other. Thus, once the level of used fixer 38 in the first fixing vessel reaches the height of the wall 40 between the first fixing vessel and the intermediate vessel 20, the used fixer overflows into the intermediate vessel 20, and fills the latter to the height of the overflow 42 therefrom, to constitute the intermediate treatment liquid 44. As an alternative, used fixer 38 is pumped from the first fixing vessel 14 into the intermediate vessel 20 by means of a pump 46.

An electrolytic silver recovery cell 48 is connected to the first fixing vessel 14 and fixer is continuously pumped therethrough by means of a pump 50. The silver recovery cell may be an electrolysis unit from an "ECORAP" processor (ex Agfa-Gevaert NV) or a Curix "EOSFIX" electrolysis unit (ex Agfa-Gevaert NV) operated according to the manufacturer's instructions.

Rinse water 51 is added to the rinsing vessel 18 at 52 and discharged at 54. After leaving the rinsing vessel 18, the photographic material passes to a dryer not shown.

In use, the photographic material is developed by treatment with a developer 26 and then passes into the intermediate treatment liquid 44, containing used fixer, where carried-over developer is removed. The developed photographic material is then fixed by treatment with the fixer 32, 38 while reducing the level of silver ions in the fixer by electrolysis. The photographic material is treated with the intermediate treatment liquid 44 for a period of time preferably less than 25% that of the fixer treatment time.

Within the scope of this invention it is clear that in the apparatus according to the present invention, making use of the method of the present invention sheet materials such as X-ray film, pre-sensitised plates, graphic art films and paper, offset plates etc. can be processed. Particularly any film for medical diagnostic imaging may be processed, wherein said film may be exposed with a laser directed by digitized data obtained after conversion of information captured by suitable means after exposure to radiation of part of the human body or exposed after conversion of X-rays by one or two intensifying light-emitting screen(s) brought into contact with the said film and wherein said film may comprise cubic and/or {111} or {100} tabular silver halide crystals rich in silver chloride, provided that with minimum amounts of silver coated a sufficient covering power is attained in the film after rapid ecological processing (with e.g. ascorbic acid and/or derivatives thereof as developing agent(s)) in a (preferentially) hardener-free developer and an odour-free fixer, optionally free from aluminum ions, thereby reducing sludge, with replenishing amounts for developer and fixer as low as possible and further provided that an optimized relationship is attained between sensitometry and image quality, especially sharpness, partly thanks to low cross-over exposure in the case of double-side coated films.

The fixing liquids 32, 38 are regenerated by the addition thereto of the regeneration liquid 34. The regenerating liquid 34 is added at a rate of preferably not more than 25 ml/g Ag. While the fixer 32 is regenerated by the addition of the regeneration liquid 34 thereto, used fixer 38 is simultaneously transferred to the intermediate treatment liquid 44, and used intermediate treatment liquid is discharged 42. The rate of addition of the regeneration liquid 34 to the fixer, the rate of transfer of used fixer 38 to the intermediate treatment liquid 44 and the rate of discharge of used intermediate liquid are such, in relation to each other, as to maintain the volumes of the fixer and the intermediate liquid substantially constant.

EXAMPLES

In the following examples exposed photographic film, namely graphics arts film A815p, 50% exposed, was processed using a number of different experimental set-ups.

The developer used was G101c (1+2) (ex Agfa-Gevaert NV) and the development time was 30 seconds at 35° C. The developer was regenerated at 125 ml/m$^2$.

The intermediate treatment was either absent, utilised tap water refreshed at 250 ml/m$^2$, or utilised overflow from the fixer, according to the example. The intermediate treatment time was 7 seconds.

The fixer had the following formulation:

| | |
|---|---|
| Ammonium thiosulphate solution (59%) | 210 ml |
| Sodium sulphite | 55 g |
| Sodium Acetate | 35 g |
| Acetic acid | 10 ml |

used at 30° C. The fixer was regenerated at 20 ml/g $Ag^+$ removed by electrolysis. Fixing time was 30 seconds.

Rinsing was carried out with tap water at 250 ml/m$^2$.

The clearing time of undeveloped SF712p film (ex Agfa Gevaert NV) was measured in vitro without agitation and this was used to monitor the fixing ability of the fixing solution in the examples.

The results were as follows.

| No. | Configuration | Times (intermediate + fixing) secs. | Clearing time (secs.) | Result |
|---|---|---|---|---|
| 1 | D/F/R | 0 + 30 | 82 | Not well fixed, not archivable |
| 2 | D/F + e/R | 0 + 30 | 62 | Not well fixed, not archivable |
| 3 | D/W/F + e/R | 7 + 30 | 15 | OK |
| 4 | D/F/F + e/R | 30 + 30 | 15 | OK |
| 5 | D/IUF/F + e/R | 7 + 30 | 15 | OK |

D = developer section
F = fixer section without electrolytic silver recovery
F + e fixer section with electrolytic silver recovery
R = rinsing after fixing
W = intermediate rinsing with water between developer and fixer
IUF = intermediate rinsing using used fixer.

In Examples 1 and 2, the film was not well fixed, resulting in poor archivability. Example 3 delivers, in general, films with good quality. However, this configuration causes an extra waste stream of brownish dirty fluid, due to the oxidation of the developer carried over into the intermediate section. Moreover, the films are more susceptible to staining due to accumulated dirt.

Example 4 delivers good results but with substantial loss of time.

Example 5 (the invention) shows the fastest way to obtain good film results without causing an extra waste stream. After 500 m$^2$ of processed film, no negative points were detected for this configuration. In this example, the fixing step substantially takes place in the fixing bath. Only between 10 and 20% of the silver to be fixed is liberated in the intermediate treatment liquid.

A further preferred embodiment of the present invention thus provides a method of processing photographic material comprising developing said photographic material by treatment with a developer (26), and fixing said developed photographic material by treatment with a fixer (32, 38) while reducing the level of silver ions in said fixer by electrolysis, wherein, between said developing and said fixing, said photographic material is treated with an intermediate treatment liquid (44) containing used fixer for a period of time less than the treatment time with said fixer, and wherein said fixing takes place in one or more fixing vessels (14, 16) which are regenerated by the addition thereto of a regeneration liquid (34) is added at a rate of less than 100 ml/g silver to be fixed, preferably less than 75, such as less than 50, especially not more than 25 ml/g Ag.

We claim:

1. A method of processing photographic material comprising developing said photographic material by treatment with a developer (26), and fixing said developed photographic material by treatment with a fixer (32, 38) while reducing the level of silver ions in said fixer by electrolysis, characterised in that, between said developing and said fixing, said photographic material is treated with an intermediate treatment liquid (44) for a period of time less than the treatment time with said fixer, said intermediate treatment liquid containing used fixer.

2. A method according to claim 1, wherein said photographic material is treated with said intermediate treatment liquid (44) for a period of time less than half that of said fixer treatment time, preferably less than 25% that of said fixer treatment time.

3. A method according to claim 1, wherein said fixing takes place in one or more fixing vessels (14, 16) which are regenerated by the addition thereto of a regeneration liquid (34).

4. A method according to claim 3, wherein said regenerating liquid (34) is added at a rate of less than 100 ml/g silver.

5. A method according to claim 3, wherein while said fixer (32) is regenerated by the addition of said regeneration liquid (34) thereto, used fixer (38) is simultaneously transferred to said intermediate treatment liquid (44), and used intermediate treatment liquid is discharged (42).

6. A method according to claim 3, wherein the rate of addition of said regeneration liquid (34) to said fixer, the rate of transfer of used fixer (38) to said intermediate treatment liquid (44) and the rate of discharge of used intermediate liquid are such, in relation to each other, as to maintain the volumes of said fixer and said intermediate liquid substantially constant.

* * * * *